US006899644B1

(12) United States Patent
Song et al.

(10) Patent No.: US 6,899,644 B1
(45) Date of Patent: May 31, 2005

(54) REUSABLE GOLF TEE WITH BI-DIRECTIONALLY PIVOTAL HEAD

(76) Inventors: Gary G. Song, 24 Stonewold Way, Greenville, DE (US) 19807-2568; Peter S. Song, 24 Stonewold Way, Greenville, DE (US) 19807-2568

( * ) Notice: Subject to any disclaimer, the term of this patent is extended or adjusted under 35 U.S.C. 154(b) by 0 days.

(21) Appl. No.: 10/439,887

(22) Filed: May 19, 2003

(51) Int. Cl.[7] ..... A63B 57/00
(52) U.S. Cl. ..... 473/397
(58) Field of Search ..... 473/387–403, 473/408

(56) References Cited

U.S. PATENT DOCUMENTS

| | | | | | |
|---|---|---|---|---|---|
| 1,623,119 | A | * | 4/1927 | Kearney | 473/391 |
| 1,807,377 | A | * | 5/1931 | De Witt | 473/397 |
| 1,942,672 | A | * | 1/1934 | Thompson | 473/392 |
| 2,146,736 | A | * | 2/1939 | Hammond et al. | 473/397 |
| 2,839,304 | A | | 6/1958 | Lerick | |
| 3,406,978 | A | * | 10/1968 | Johnson, Jr. | 473/397 |
| 3,414,268 | A | | 12/1968 | Chase | |
| 3,966,214 | A | | 6/1976 | Collins | |
| 4,418,916 | A | | 12/1983 | Matsuura | |
| 4,645,208 | A | * | 2/1987 | Morabeto | 473/397 |
| D301,046 | S | | 5/1989 | Morabeto | |
| 5,033,747 | A | | 7/1991 | Young | |
| D360,006 | S | | 7/1995 | Samples | |
| D370,041 | S | | 5/1996 | Thomas | |
| 5,755,629 | A | * | 5/1998 | Blomgren | 473/408 |

* cited by examiner

*Primary Examiner*—Steven Wong
(74) *Attorney, Agent, or Firm*—John D. Gugliotta; Olen L. York, III

(57) ABSTRACT

A reusable golf tee having a bidirectionally pivotal head comprises a head member, a peg member and pivot means coupling the head member and peg member. The head member includes a concave perch for nesting a golf ball thereon for tee shots. The head member further includes an elongated shaft axially projected downward from the perch and insertable into a channel formed between a pair of shoulders on the peg member. The peg member also includes a tapered tip to facilitate insertion into a tee area. Pivot means permits the head member to pivot as forces act on the head member and peg member collectively. Pivoting of the head member may be accomplished in two directions (bidirectional).

14 Claims, 4 Drawing Sheets

REUSABLE GOLF TEE WITH BI-DIRECTIONALLY PIVOTAL HEAD

RELATED APPLICATIONS AND DISCLOSURES

The present application was first described in Disclosure Document Registration 521,782 filed on Nov. 15, 2002 under 35 U.S.C. § 122 , 37 C.F.R. § 1.14 and MPEP § 1706. There are no previous nor currently any co-pending applications anywhere in the world.

BACKGROUND OF THE INVENTION

1. Field of the Invention

The present invention relates generally to golfing tees, and more particularly to a golfing tee having separate head and base members, wherein the head is bi-directionally pivotal about pivoting means.

2. Description of the Related Art

Golf is a sport growing in popularity, both in viewership and participation. The golfing tees presently used are dominated by the wooden variety. Wooden golf tees are easily broken by the impact delivered by a golf club. As such, golf tees are easily consumed, but not necessarily easily replaced. The golfer frequently must replenish his/her supply of golf tees by purchasing bags or in bulk. Further, replacing wooden golf tees requires the consumption of wood sources, especially trees.

A search of the prior art did not disclose any patents that read directly on the claims of the instant invention; however, the following references were considered related:

U.S. Pat. No. 2,839,304, issued in the name of Lerick, discloses a flexible golf tee featuring a resiliently flexible head connected to a tapering base about a resilient element;

U.S. Pat. No. 3,414,268, issued in the name of Chase, discloses a golfing tee having a pointed end for insertion into the ground and a cupped seat (opposite to the pointed end) for holding a golf ball placed therein, the cupped seat comprising a plurality of petals yieldingly flexible;

U.S. Pat. No. 3,966,214, issued in the name of Collins, discloses an improved, reusable tee comprising shank and head elements connected to one another and providing limited pivotal movement of the head element in relation to the shank element;

U.S. Pat. No. 4,418,916, issued in the name of Matsuura, discloses a golf tee comprising a peg member for insertion into the ground and a head member for placement of a golf ball thereon, and an elastic member (spring) provided between the peg member and the head member;

U.S. Pat. No. 5,033,747, issued in the name of Young, discloses a golf tee assembly with at least one reusable tee attached from a retaining member anchored to a teeing ground;

U.S. Pat. No. Des. 301,046, issued in the name of Morabeto, discloses an ornamental design for a golfing tee comprising a head portion for holding a golf ball, a tail portion for insertion into the ground, and an intermediate portion capable of collapse upon impact by a golf club;

U.S. Pat. No. Des. 360,006, issued in the name of Sample, discloses an ornamental design for a golfing tee comprising a screw driven through a hexagonal base, with a resilient spring attached on the opposite end of the base and supporting a dowel and a cupped top; and U.S. Pat. No. Des. 370,041, issued in the name of Thomas, discloses an ornamental design for an adjustable height golfing tee comprising an elongated tee portion having a cupped head and a pointed tail and notches intermediate thereto, wherein a disc is impinged by the notches and permits vertical adjustment of the disc to act as a height guide for setting the tee into the ground.

Consequently, a need has been felt for providing an improved golfing tee that provides a bi-directionally displaceable head member upon impact of a golf club, and allows for repositioning and repeated use of the same golfing tee.

SUMMARY OF THE INVENTION

It is therefore an object of the present invention to provide an improved golfing tee.

It is another object of the present invention to provide an improved golfing tee having a bi-directionally displaceable head member coupled to a peg member via pivot means.

It is another object of the present invention to provide an improved golfing tee having pivot means forcibly impinging the head member in a substantially vertical position.

Briefly described according to one embodiment of the present invention, a reusable golfing tee with a bi-directional pivoting head member comprises a head member coupled to a peg member about pivot means. The head member includes perch, allowing a golf ball to nest thereon, and a linearly elongated and downwardly projecting shaft. The shaft is inserted into a channel formed between a pair of shoulders on the peg member. The peg member is linearly elongated and includes a tapered tip at the end opposite the shoulders for facilitating insertion of the golfing tee into the ground. Pivot means may include a pivotal pin, ball-and-socket joints, flexible elastomers elements and other similar means for allowing pivoting movement of the head member.

The reusable golfing tee provides an apparatus that allows for repeated use of a single golfing tee in lieu of breaking and replacing wooden tees most commonly used in playing golf.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
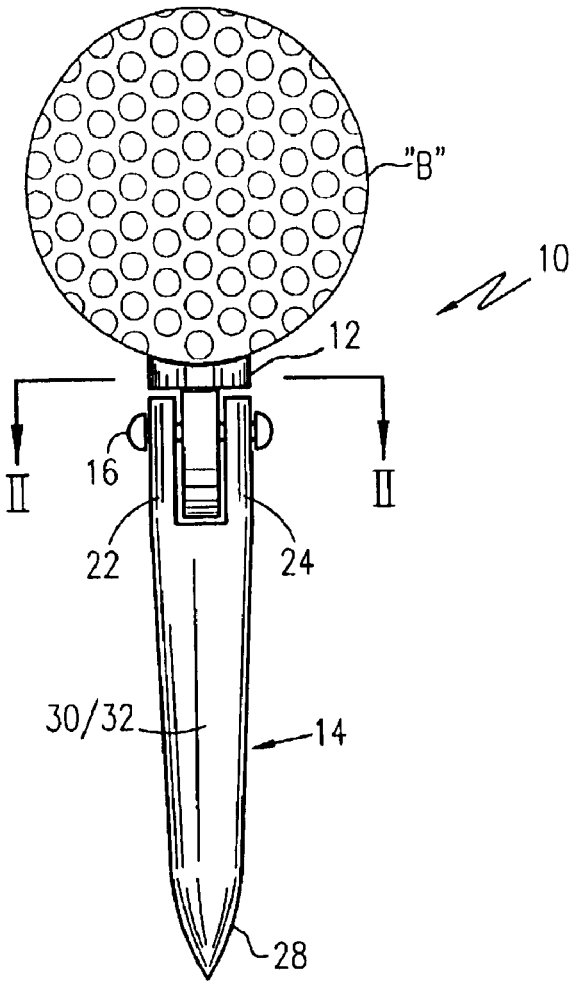
FIG. 1 is an elevational view of a golfing tee having a head member bi-directionally displaceable about a peg member.
Figure 2:
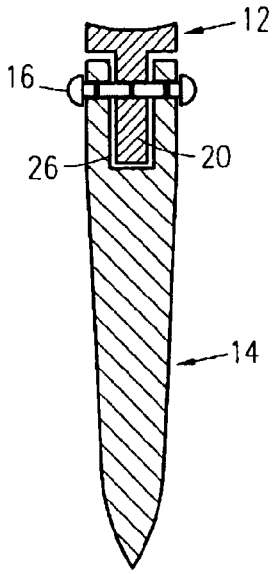
FIG. 2 is a cross-sectional view of the golfing tee taken along line II—II.
Figure 3:
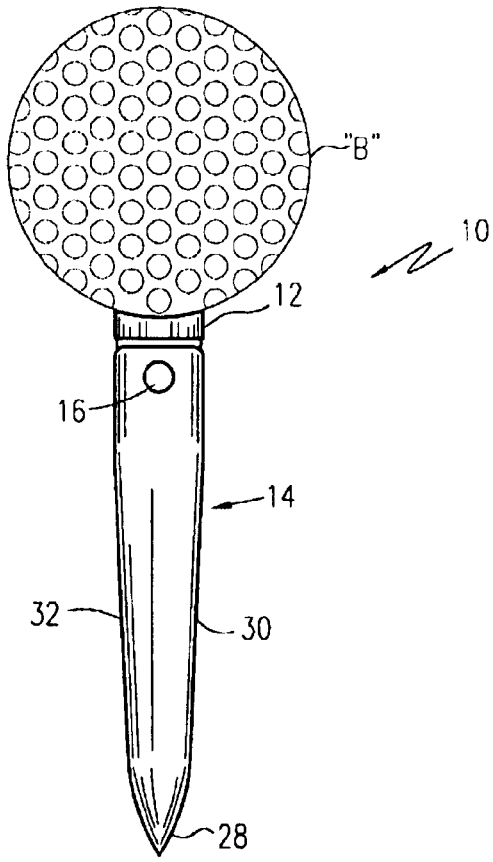
FIG. 3 is a side elevational view of the golfing tee.
Figure 4:
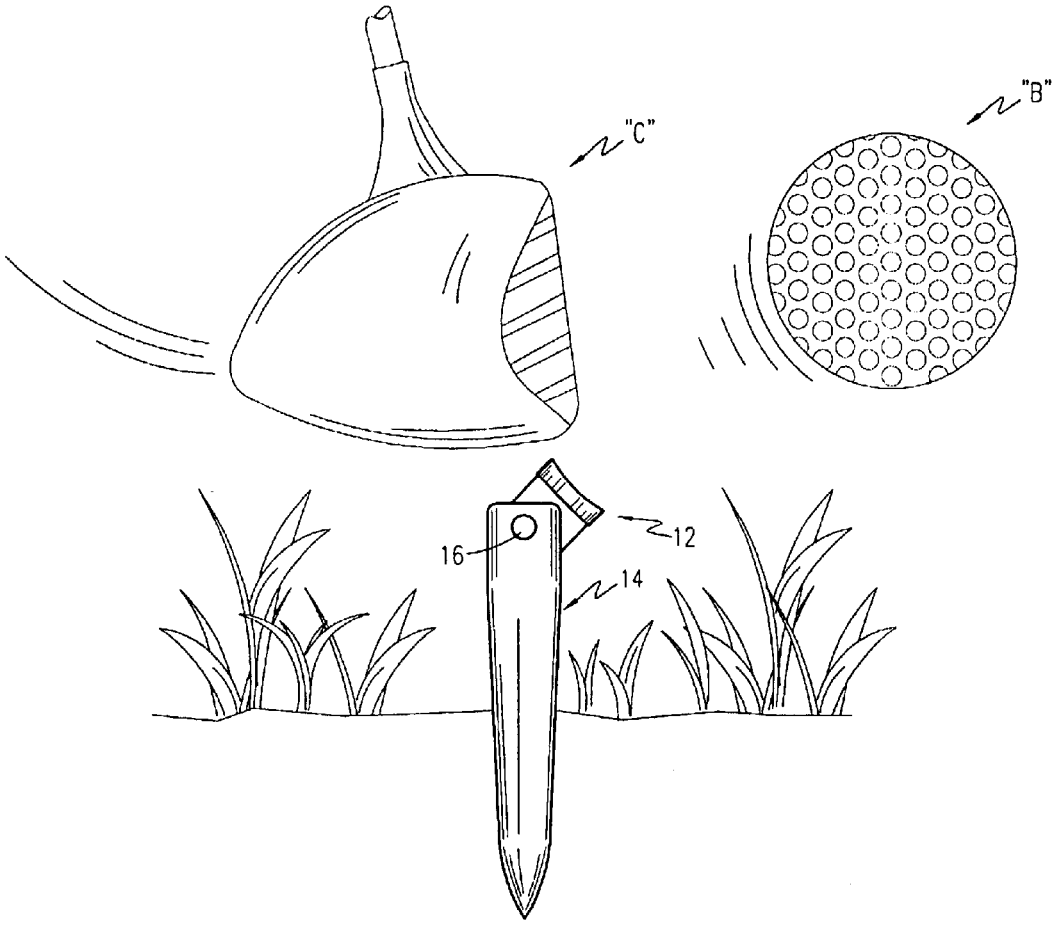
FIG. 4 is a partial perspective view of the golfing tee struck by a golf club, wherein the strike displaces the head member in the same direction as the club and ball are traveling.

The best mode for carrying out the invention is presented in terms of its preferred embodiment, herein depicted within the FIGS. 1 through 8.

1. Detailed Description of the Figures

Referring now to FIG. 1 through FIG. 4, a golf tee 10 in accordance with a preferred embodiment of the present invention is shown. The golf tee 10 comprises a head member 12 and a peg member 14 coupled together about pivot means 16. The peg member 14 is inserted into the ground and supports the head member 12 and golf ball "B". After the user strikes the ball "B" with a golf club "C", the force of impact will result in the head member 12 pivoting about pivot means 16 in the direction that the club "C" and ball "B" are traveling. The head member 12 may be repositioned in vertical alignment with the peg member 14 for repeated use of the golf tee 10 on subsequent shots as required.

The head member 12 comprises a perch 18 for allowing the ball "B" to nest therein. The perch 18 is at an upper terminal end of the head member 12 and integrally coupled to an elongated shaft 20 axially projected downward therefrom. The perch 18 may be concave (if looking down onto the perch 18) or may be substantially hollow, so long as a regulation golf ball "B" is able to nest on the perch 18 without falling after placement onto the tee 10. The shaft 20 inserts into a channel 26 formed between a pair of shoulders 22 and 24 of the peg member 14, and is resiliently biased in a vertical orientation. The shaft 20 may have a tapered or non-tapered tip 22 for separately inserting the head member 12 into the ground as desired. It is envisioned that the head member 12 may be pivoted about the peg member 14 (in either of the two directions allowed) to lower the profile of the golf tee 10 for tee shots with driving clubs (for lower trajectory shot-making) and/or irons. Pivot means 16 penetrate the peg member 14 and the shaft 20, providing means for bi-directional pivoting displacement of the head member 12 in response to impact forces of a golf club "C".

The peg member 14 is an elongated member comprising a pair of shoulders 22 and 24 and forming a channel 26 therebetween, wherein the channel 26 receives the shaft 20 of the head member 12. At an end of the peg member 14, opposite to the pair of shoulders 22 and 24, a tapered tip 28 is provided to facilitate insertion of the golf tee 10 into the ground. It is envisioned that the peg member 14 may have a substantially cylindrical configuration about the exterior surface, with a substantially conical configuration about the tip 28. It is further envisioned that the peg member 14 may have a more flat surface about two opposing sides of the peg member 14, especially from near the base of the channel 26 to the tip 28. The plane of the opposing flat surfaces 30 and 32 lies substantially perpendicular to the plane of the bi-directional pivoting action of the head member 12 so that there is increased surface area about the tip 28 (as compared to a conically configured tip 28) to more securely impinge the golf tee 10 in place during use.

Figure 5:
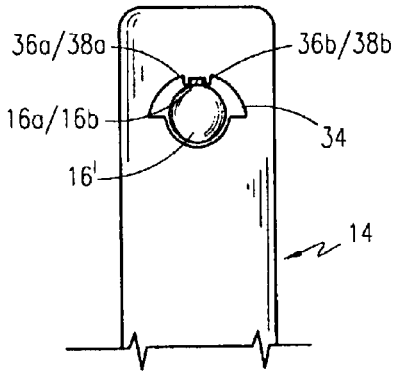
FIG. 5 is a side view of the peg member and shoulder to illustrate the pin as housed within the aperture and indicating the impingement of the pin absent forcible displacement of the head member.
Figure 6:
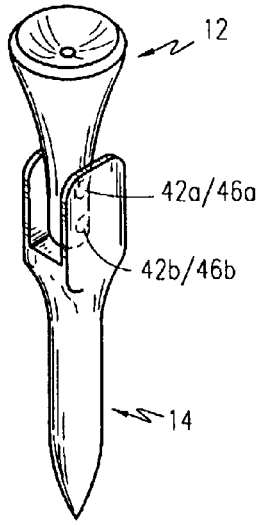
FIG. 6 is a perspective view of an alternate embodiment of the golfing tee, wherein a plurality of ball-and-sockets are used as pivot means.
Figure 7:
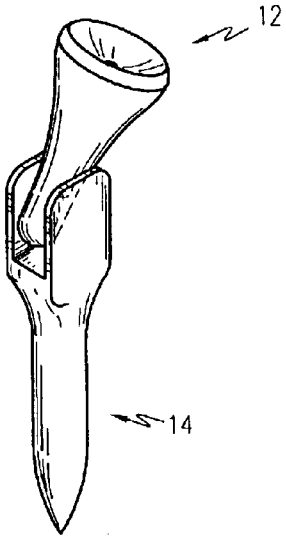
FIG. 7 is a perspective view of the golfing tee in FIG. 6 after forcible displacement of the head member.
Figure 8:
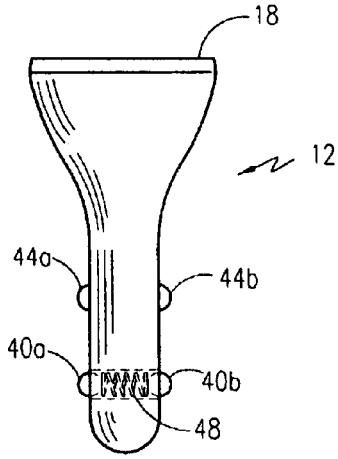
FIG. 8 is a front or rear view of the head member of the embodiments disclosed in FIG. 6 and FIG. 7, illustrating the fixed state of the top balls and the outwardly biased spring urging the lower balls into corresponding sockets.

Pivot means 16 is envisioned as a variety of particular elements, including a pin (as depicted in FIG. 1 through FIG. 4) or other returnably resilient element. As depicted in FIG. 5, the pin 16' is a linearly elongated member that transverses the coupling of the head member 12 and the peg member 14. The pin 16' includes a pair of teeth 16*a* and 16*b*, wherein each tooth 16*a* and 16*b* are aligned in the same plane along the circumference of the pin 16'. The pin 16' is inserted within an aperture 34 that transverses the coupling of the head and peg members 12 and 14. Within the aperture 34, and corresponding to each respective tooth 16*a* and 16*b*, a first pair of detents 36*a* and 36*b* and a second pair of detents 38*a* and 38*b* are formed at each end of the aperture 34. The pair of detents 36*a* and 36*b* (and 38*a* and 38*b*) frictionally impinge the respective tooth 16*a* or 16*b* until such force is applied by a striking golf club "C" that the teeth 16*a* and 16*b* are forcibly displaced from the frictional impingement in either direction (bi-directional displacement). To vertically realign the head member 12 in relation to the peg member 14, the user will forcibly displace the teeth 16*a* and 16*b* between the detents 36*a* and 36*b* (and 38*a* and 38*b*). Other pivot means 16 envisioned include the use of flexible elastomers to impinge the head member 12 within the peg member 14 and permit the bi-directional displacement discussed earlier, and further permit the realignment of the head member 12 in a vertical position.

Still another pivot means 16 envisioned is that of a ball-and-socket joint, wherein a plurality of balls are positioned along the shaft 20 and enervate with a plurality of ball-shaped sockets positioned along the shoulders 22 and 24. In one embodiment of the ball-and-socket joint pivot means 16, depicted in FIG. 6, FIG. 7 and FIG. 8, a pair of ball bearings 40*a* and 40*b* are positioned along one side (with corresponding pair of sockets 42*a* and 42*b*) and a second pair of ball bearings 44*a* and 44*b* are positioned along the opposite side (also with corresponding pair of sockets 46*a* and 46*b*). The upper ball bearings 40*a* and 44*a* are permanently affixed to the respective sockets 42*a* and 46*a*, respectively, and the lower ball bearings 40*b* and 44*b* are forcibly displaced with the application of sufficient force. The application of said sufficient force permits the bi-directional displacement of the head member 12 by pivoting about the upper ball bearings 40*a* and 44*a* and release of lower ball bearings 40*b* and 44*b*. To realign the head member 12 in a vertical orientation, the lower ball bearings 40*b* and 44*b* are provided with an outwardly biased spring 48 that permits the forcible internal compression of the ball bearings 40*b* and 44*b* so that the shaft 20 might be rotated back to vertical and the ball bearings 40*b* and 44*b* repositioned within the respective sockets 42*b* and 46*b*. In an alternative embodiment, the lower ball bearings 40*b* and 44*b* and the corresponding spring 48 are not provided, wherein the flexible elasticity of the pivot means 16 permits the forcible repositioning of the device.

It is envisioned that the golfing tee 10 will be constructed from a durable material capable of withstanding repeated strikes from metal golf clubs. Metal, wood and/or plastic are envisioned as appropriate materials. It is further envisioned that the head member 12 and the peg member 14 may be of different colors, so that if the head member 12 is mechanically separated from the peg member 14, the separated members 12 and 14 might be easier to locate. It is further envisioned that the golfing tee 10, and the component members 12 and 14, may be provided in varying lengths. A standard golfing tee is approximately an inch and one-half inches (1.5" or 3.8 cm) to three inches (3" or 7.6 cm), thus the golfing tee 10 may be manufactured to accommodate standard size tees, and may also be customized for longer tees for speciality shots.

2. Operation of the Preferred Embodiment

A golfer will ensure that the head member 12 is oriented in an appropriate position for supporting a golf ball "B" for teeing off. In most instances, the head member 12 will be aligned in a substantially vertical orientation in relation to the peg member 14. The golfer will then swing a golf club "C" and strike the ball "B". If the club "C" strikes the head member 12 with sufficient force, the head member 12 will be forcibly displaced in the direction the club "C" is traveling and pivot about pivot means 16. The golfer may then retrieve the tee 10 and reposition the head member 12 in the vertical orientation.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A reusable golf tee with a bidirectionally pivotal head comprising:

a head member for supporting a golf ball;

a peg member for insertion into a tee area; and pivot means, said pivot means coupling said head member with said peg member in a bidirectionally pivoting manner, said pivot means allows pivoting of said head member upon impact of a club striking said golf ball;

wherein said pivot means comprises a linearly elongated pin that couples said head member and said peg member, said pin further comprising a pair of teeth aligned in a same plane along a circumference of said pin, said pair of teeth positioned at opposite ends of said pin.

2. The golf tee of claim 1, wherein said pin is inserted through an aperture that transverses said head member and said peg member.

3. The golf tee of claim 2, wherein said aperture comprises:

a first pair of detents at an end of said aperture, said first pair of detents functionally impinging one of said pair of teeth therebetween;

a second pair of detents at an end of said aperture opposite said first pair of detents, said second pair of detents frictionally impinging remaining one of said pair of teeth therebetween;

said first pair of detents and said second pair of detents releasing respective said pair of teeth as a force applied by a striking golf club forcibly displaces said pair of teeth from said first pair of detents and said second pair of detents.

4. A reusable golf tee with a bidirectionally pivotal head comprising:

a head member for supporting a golf ball;

a peg member for insertion into a tee area; and pivot means said pivot means coupling said head member with said peg member in a bidirectionally pivoting manner, said pivot means allows pivoting of said head member upon impact of a club striking said golf ball, said pivot means comprising a plurality of ball bearings and a plurality of ball-shaped sockets, said plurality of sockets formed along an internal surface of a pair of shoulders of said peg member, said plurality of sockets configured to receive and house said plurality of ball bearings;

said plurality of ball bearings comprising an upper pair of ball bearings permanently affixed to a pair of upper sockets and a lower pair of ball bearings frictionally impinged within a pair of lower sockets, said lower pair of ball bearings forcibly displaced by application of force applied by a striking golf club, thereby permitting said head member to pivotal bidirectionally about said upper pair of ball bearings and said upper sockets.

5. A reusable golf tee with a bidirectionally pivotal head comprising:

a head member comprising a concave perch integrally coupled with a shaft axially projected downward therefrom, said concave perch permitting a golf ball to nest thereon;

a peg member comprising a pair of shoulders and a channel therebetween, said channel receiving said shaft, said peg member further comprising a tapered tip opposite to said pair of shoulders, said tip facilitating insertion of said golf tee into a tee area; and pivot means pivotally attaching said shaft to said pair of shoulders, said pivot means permitting pivoting of said head member upon impact by a golf club, said pivot means comprising a linearly elongated pin that couples said head member and said peg member, said pin further comprising a pair of teeth aligned in a same plane along a circumference of said pin, said pair of teeth positioned at opposite ends of said pin, said pin is inserted through an aperture that transverses said head member and said peg member.

6. The golf tee of claim 5, wherein said aperture comprises:

a first pair of detents at an end of said aperture, said first pair of detents frictionally impinging one of said pair of teeth therebetween;

a second pair of detents at an end of said aperture opposite said first pair of detents, said second pair of detents frictionally impinging remaining one of said pair of teeth therebetween; said first pair of detents and said second pair of detents releasing respective said pair of teeth as a force applied by a striking golf club forcibly displaces said pair of teeth from said first pair of detents and said second pair of detents.

7. The golf tee of claim 5, wherein said tip comprises a pair of flat surfaces opposite each other, each of said pair of flat surfaces having planes substantially perpendicular to a plane of bidirectional pivot of said head member, thereby providing increased surface area about said tip for increased impingement of said golf tee into said tee area.

8. The golf tee of claim 1, wherein said head member comprises:

a perch for supporting a golf ball;

an elongated shaft axially projected downward from said perch, said shaft resiliently biased in a vertical orientation by said pivot means.

9. The golf tee of claim 8, wherein said perch is concave, thereby permitting a golf ball to nest thereon.

10. The golf tee of claim 8, wherein said shaft is inserted into a channel formed between a pair of shoulders of said peg member.

11. The golf tee of claim 10, wherein said pivot means penetrates said peg member and said shaft.

12. The golf tee of claim 1, wherein said peg member is an elongated member comprising:

a pair of shoulders, said pair of shoulders forming a channel therebetween, said channel receiving a shaft of said head member; and a tapered tip, said tip formed at an end of said peg member opposite to said pair of shoulders, said tip facilitating insertion of said golf tee into said tee area.

13. The golf tee of claim 12, wherein said tip comprises a substantially conical configuration about an exterior surface.

14. The golf tee of claim 12, wherein said tip comprises a pair of flat surfaces opposite each other, each of said pair of flat surfaces having planes substantially perpendicular to a plane of bidirectional pivot of said head member, thereby providing increased surface area about said tip for increased impingement of said golf tee into said tee area.

* * * * *